US007815462B2

(12) United States Patent
Boeck et al.

(10) Patent No.: US 7,815,462 B2
(45) Date of Patent: Oct. 19, 2010

(54) CONNECTOR AND METHOD OF TERMINATING ELECTRIC LEADS TO A CONNECTOR

(75) Inventors: Werner Boeck, Gross-Umstadt (DE); Rudolf E. Kraemer, Lautertal (DE); Ralf Schmidt, Fuerth (DE); Martin Szelag, Blokenbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/481,975

(22) Filed: Jun. 10, 2009

(65) Prior Publication Data

US 2009/0305543 A1 Dec. 10, 2009

(30) Foreign Application Priority Data

Jun. 10, 2008 (DE) ..... 10 2008 027 512

(51) Int. Cl.
*H01R 4/24* (2006.01)

(52) U.S. Cl. ..... 439/409; 439/418

(58) Field of Classification Search ..... 439/417, 439/404, 405, 409, 410, 418, 76.1
See application file for complete search history.

(56) References Cited

U.S. PATENT DOCUMENTS

| | | | | |
|---|---|---|---|---|
| 4,473,263 | A | 9/1984 | Sunstein | |
| 4,573,752 | A | 3/1986 | Rich | |
| 5,080,609 | A | 1/1992 | Fabian et al. | |
| 6,722,914 | B2 * | 4/2004 | Blaha | 439/404 |
| 6,984,147 | B2 * | 1/2006 | Tricaud et al. | 439/509 |
| 7,273,387 | B2 * | 9/2007 | Shimirak | 439/417 |
| 2007/0066123 | A1 * | 3/2007 | Arlitt et al. | 439/409 |

FOREIGN PATENT DOCUMENTS

| | | |
|---|---|---|
| DE | 3605063 C1 | 10/1987 |
| DE | 9003067.2 | 8/1990 |
| DE | 9116062.6 | 4/1992 |
| DE | 4232622 C1 | 3/1994 |
| DE | 9401974.6 | 5/1994 |
| DE | 4321331 A1 | 1/1995 |
| DE | 9218745.5 | 6/1995 |

(Continued)

OTHER PUBLICATIONS

Deutsches Patent—und Markenamt Examination Report dated Mar. 13, 2009, 7 pages.

*Primary Examiner*—Phuong K Dinh
(74) *Attorney, Agent, or Firm*—Barley Snyder LLC

(57) ABSTRACT

An electric plug having a first connection region, a second connection region, and a contact carrier. The first connection region, having at least one vertical contact, is provided for connecting at least one electrical conductor, while the second connection region includes at least one horizontal contact for contacting a counter connector which is to be connected to the electric plug. The contact carrier includes an upper surface on which the vertical and horizontal contacts are provided, with the contact carrier being configured to electrically interconnect the first and second connection regions. Furthermore, the contact carrier is arranged in a housing, forming a datum plane on the lower side of the housing in the plug-in direction, with the upper surface of the contact carrier is arranged in an inclined position with respect to the datum plane.

30 Claims, 9 Drawing Sheets

FOREIGN PATENT DOCUMENTS

| | | | |
|---|---|---|---|
| DE | 29521330 | U1 | 2/1997 |
| DE | 29817464 | U1 | 1/1999 |
| DE | 20012393 | U1 | 10/2000 |
| DE | 10057833 | A1 | 6/2002 |
| DE | 102004038123 | A1 | 2/2006 |
| DE | 102006010279 | A1 | 9/2007 |

* cited by examiner

CONNECTOR AND METHOD OF TERMINATING ELECTRIC LEADS TO A CONNECTOR

CROSS-REFERENCE TO RELATED APPLICATIONS

This application claims the benefit of the filing date under 35 U.S.C. §119(a)-(d) of German Patent Application No. DE 10 2008 027 512.3 filed Jun. 10, 2008.

FIELD OF THE INVENTION

The present invention relates to an electric plug comprising a first connection region in which at least one vertical contact is provided for connecting at least one electrical conductor, and comprising a second connection region in which at least one horizontal contact is provided for contacting a counter connector which is to be connected to the electric plug, and also comprising a contact carrier on which the contacts are provided and which electrically interconnects the first and second connection regions.

BACKGROUND

From the prior art, electric plugs of this type and corresponding connection systems are known, for example as so-called RJ45 electric plugs or RJ45 connection systems. Electric plugs of this type are used, for example for connecting electrical conductors of a cable to a corresponding counter connector, for example in the form of a corresponding socket or plug-in coupling. Provided on the end face of an electric plug of this type are horizontal contacts for contacting respective counter horizontal contacts of the counter connector. The electrical conductors of the cable are connected to a corresponding number of vertical contacts in a cable-side connection region, while provided in a second plug-in-side connection region are the horizontal contacts which are used to contact the corresponding counter horizontal contacts of the counter connector. The vertical contacts for connecting the electrical conductors and the horizontal contacts are usually positioned on a contact carrier, which electrically interconnects the cable-side connection region and the plug-in-side connection region.

A contact carrier of this type is configured, for example as a printed circuit board which is inserted horizontally into the housing of the electric plug. This has a disadvantageous effect in that, if the housing of the electric plug is flat, the connection space above the printed circuit board in which the vertical contacts are connected to the electrical conductors of the cable, is relatively small. The use in particular of insulation displacement (ID) contacts as vertical contacts for connecting the electrical conductors of the cable has the disadvantage that the contact legs of the ID contacts must accordingly be relatively short. This is particularly the case when a plurality of ID contacts are provided and are arranged in tandem in the cable-side connection region, such that electrical conductors for connection to ID contacts have to be guided in a central region of the electric plug over ID contacts which are located closer to the cable-side end of the electric plug. In order to allow these electrical conductors to be guided over the ID contacts provided on the cable-side end of the electric plug, said ID contacts have to be relatively short if the vertical extent of the housing is not to be increased.

On the other hand, electric plug configurations are also known in which the contact carrier is produced in step-form when seen in a side view. In this embodiment, the ID contacts provided on the cable-side end of the electric plug are arranged on a lower plane than the ID contacts of a row arranged downstream in the plug-in direction. This has the advantage that the electrical conductors which are to be connected to the last-mentioned ID contacts can be guided over the ID contacts which are on the cable-side end of the electric plug. However, with this embodiment as well, a relatively small space is available since the step-form contact carrier requires a relatively large amount of installation space, with the result that the ID contacts must again be relatively short.

In this respect, a short configuration of ID contacts has the disadvantage that only a relatively low multiple contacting and a relatively low contact reliability is possible, conditioned by the relatively short spring legs of the ID contacts. In this respect, relatively short spring legs have a lower resilience such that the contact quality decreases after repeated contacting and releasing of electrical conductors on the ID contacts, with the result that the contact reliability decreases with the number of multiple contacting procedures.

SUMMARY

The object of the present invention is to provide an electric plug of the type mentioned at the outset which has a relatively high contact reliability even when electrical conductors of a cable are brought into contact repeatedly with the vertical contacts of the electric plug.

The invention relates to an electric plug having a first connection region, a second connection region, and a contact carrier. The first connection region, having at least one vertical contact, is provided for connecting at least one electrical conductor, while the second connection region includes at least one horizontal contact for contacting a counter connector which is to be connected to the electric plug. The contact carrier includes an upper surface on which the vertical and horizontal contacts are provided, with the contact carrier being configured to electrically interconnect the first and second connection regions. Furthermore, the contact carrier is arranged in a housing, forming a datum plane on the lower side of the housing in the plug-in direction, with the upper surface of the contact carrier is arranged in an inclined position with respect to the datum plane.

BRIEF DESCRIPTION OF THE DRAWINGS

The invention will be described in detail in the following with reference to the figures which are shown in the drawings and are embodiments of the present invention. In the drawings.

DETAILED DESCRIPTION OF THE EMBODIMENT(S)

Figure 1:
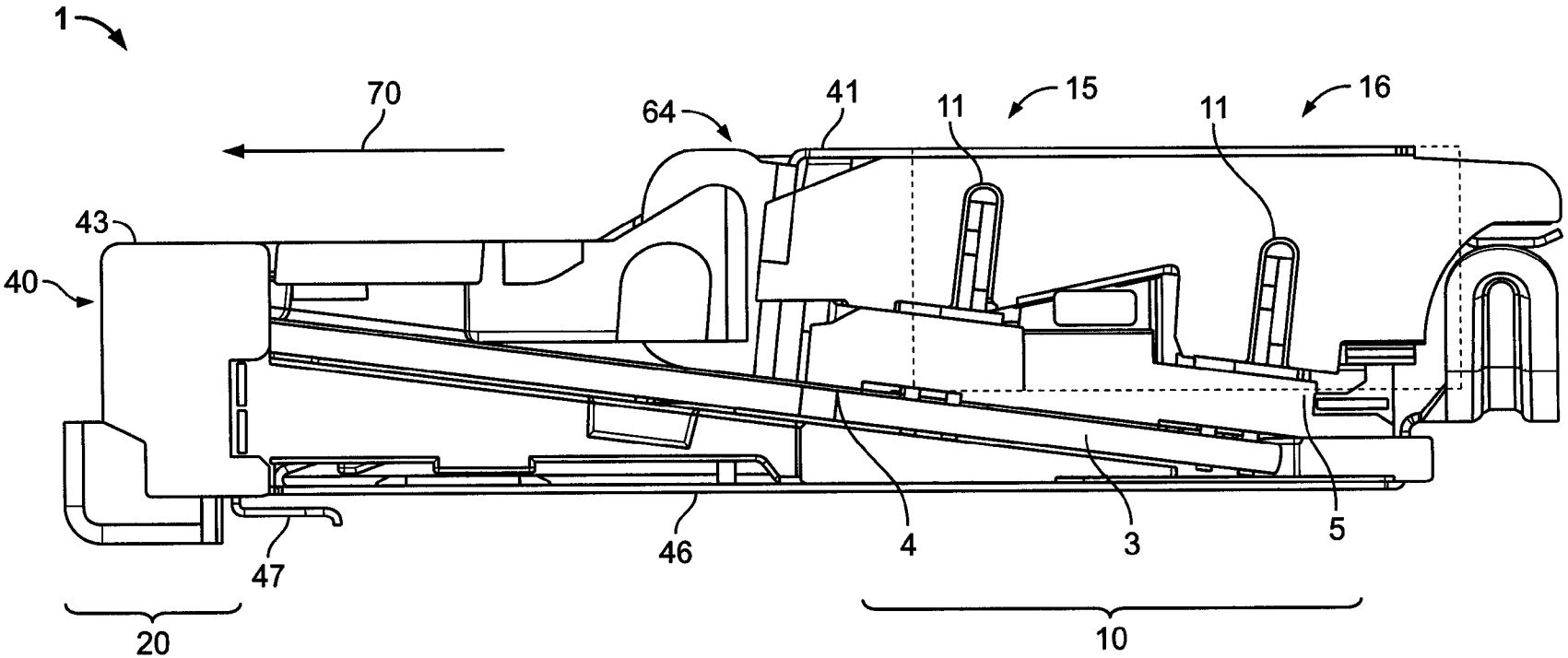
FIG. 1 is a cross-sectional view of an electric plug according to an exemplary embodiment of the invention.

FIG. 1 is a cross-sectional view of an exemplary embodiment of an electric plug according to the invention. The electric plug 1 shown in FIG. 1 has a housing 40 formed from a plurality of housing parts, as is explained in detail in the following with reference to FIGS. 4 to 7. In particular, the housing 40 includes a front housing section 43 that forms a plug-in face, configured in this embodiment as a RJ45 connection system. The contacts, arranged inside the front housing section 43, for contacting a corresponding counter connector are not visible in FIG. 1. A conventional RJ45 locking element 47, for example, is arranged on the lower side of the front housing section 43. Furthermore, the lower side of the housing 40 forms a substantially straight datum plane 46 in the plug-in direction 70.

Positioned in the housing 40 of the electric plug 1 is a contact carrier 3 in the form of a printed circuit board on which are located vertical contacts 11 for contacting elongate electrical conductors, for example of an electric cable, and horizontal contacts 21 (see FIG. 3) for contacting a counter connector which is to be connected to the electric plug 1. In this manner, there are formed in the electric plug 1 two connection regions 10 and 20, namely a first connection region 10 in which the vertical contacts 11 are located and a second connection region 20 in which the horizontal contacts for contacting the counter connector are located.

Figure 3:
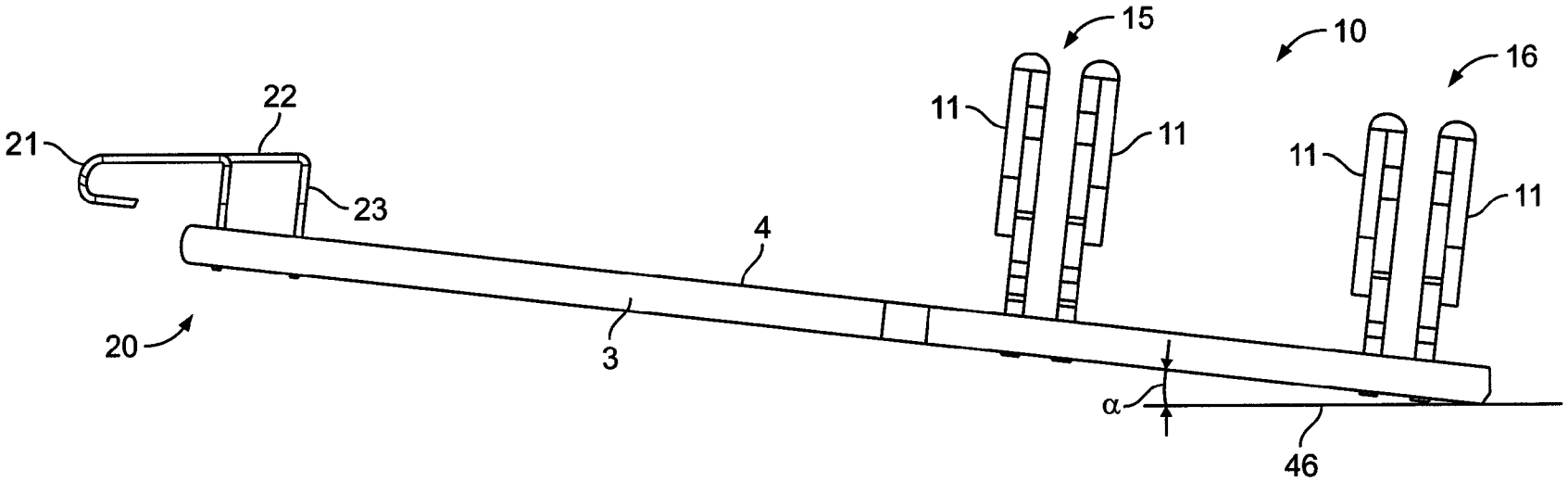
FIG. 3 is a side view of a contact carrier in the form of a printed circuit board on which the vertical contacts and horizontal contacts are arranged according to an exemplary embodiment of the invention.

In view of FIGS. 1 and 3, the contact carrier 3 (i.e. printed circuit board) forms a straight surface, or upper surface 4, on which the vertical contacts 11 of the first connection region 10 and the horizontal contacts 21 of the second connection region 20 are provided. In this respect, the contact carrier 3 is configured such that it electrically connects the first connection region 10 to the second connection region 20, for example by corresponding tracks which are provided on the contact carrier 3, but are not shown in the figures. Theses tracks connect the vertical contacts 11 with the horizontal contacts 21, in particular according to a predetermined diagrammatic plan, in this case to form a RJ45 connection system.

Positioned in the first connection region 10 is a plurality of vertical contacts 11 in the form of insulation displacement (ID) contacts, which are provided in each case for connecting a respective electrical conductor. In the present embodiment, the vertical contacts 11 are arranged on the contact carrier 3 in two rows 15 and 16, which are positioned in tandem in the plug-in direction 70 and extend transversely, in particular vertically to the plug-in direction. The horizontal contacts 21, for contacting a counter connector and each have a straight contact surface 22 which runs in the plug-in direction 70, are configured for making contact with a corresponding spring contact of the counter connector. The contact surfaces 22, which extend substantially horizontal in the plug-in direction 70, are connected to the contact carrier 3 using contact extensions 23 that extend vertically to the contact carrier 3.

The contact carrier 3, or the upper surface 4 on which the vertical contacts 11 and the horizontal contacts 21 are located, is in an inclined position with respect to the datum plane 46 of the electric plug. The datum plane 46 extends in the plug-in direction 70. In particular, the contact carrier 3, or the upper surface 4 thereof, is inclined at an acute inclination angle $\alpha$ to the datum plane 46. For example, the lower side of the contact carrier 3, as shown in FIG. 1, contacts the lower part of the housing 40 in the first connection region 10. The upper surface 4 of the contact carrier 3 is inclined, in ascending manner, with respect to the datum plane 46 in the plug-in direction 70, starting from the first connection region 10 in the direction of the second connection region 20. In other words, the upper surface 4 of the contact carrier 3 becomes increasingly distanced from the datum plane 46 in the plug-in direction 70, particularly in a continuous and linear manner such that in the connection region 20, the horizontal contacts 21 are at a vertical height with respect to the datum plane 46, in order to form a corresponding RJ45 plug-in face.

Thus, the vertical contacts 11, ID contacts, in the electric plug 1 are positioned on an inclined upper surface 4, which is inclined in ascending manner with respect to the datum plane 46 of the electric plug starting from the conductor-side first connection region 10. As a result of this, the vertical contacts 11 can be arranged in tandem in a first row 15 and in a second row 16, which makes it possible to easily insert the individual conductors from only one direction and/or from only one side (for example from above when looking at the electric plug 1 according to FIG. 1) preferably in the case of a RJ45 plug-in connection. The inclined position of the contact carrier 3 or of the upper surface 4 allows the largest possible, available spatial ratios in the conductor connection region of the electric plug due to increased installation space 5. This provides the advantage that the vertical contacts 11 can be configured to be relatively high or with relatively long spring legs, which results in an increased resilience and thus in an increased contact reliability, even when the vertical contacts 11 are contacted repeatedly. This also results in an improved contact reliability under varying temperature conditions due to the improved spring performance of the vertical contacts 11.

Figure 8:
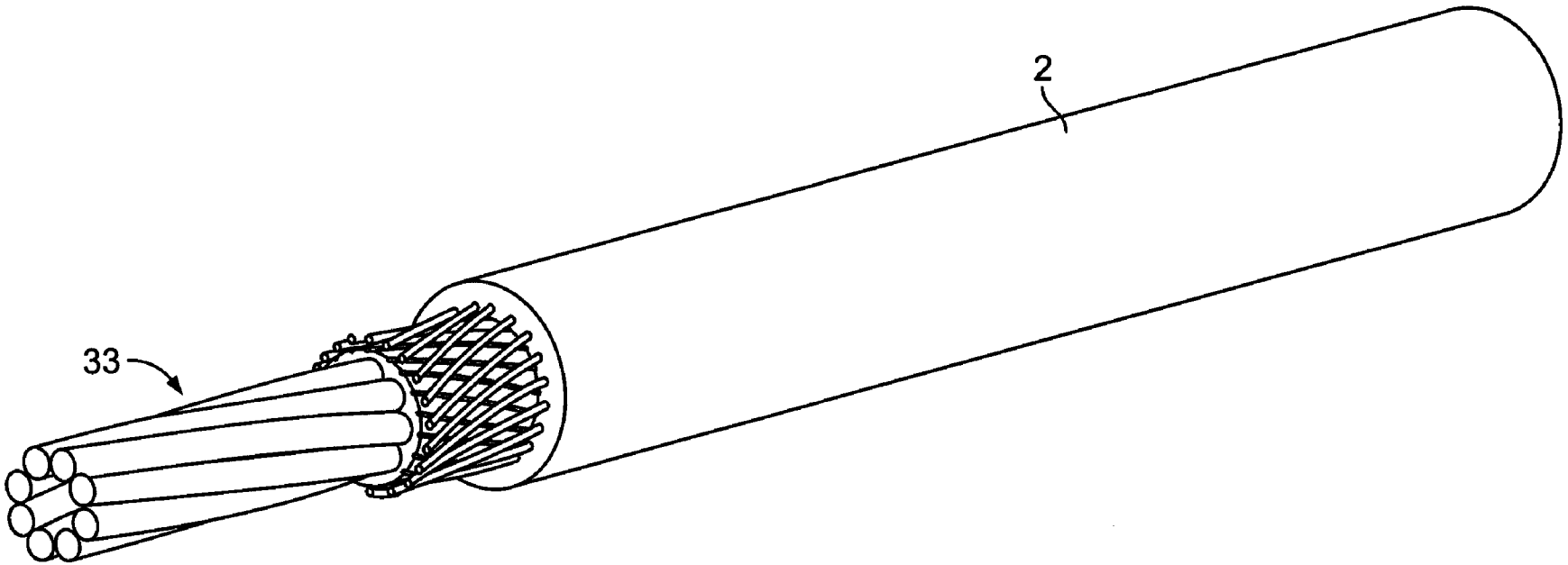
FIGS. 8 and 9 show embodiments of two different cables having two different types of electrical conductors which can both be contacted by an electric plug according to the invention.
Figure 9:
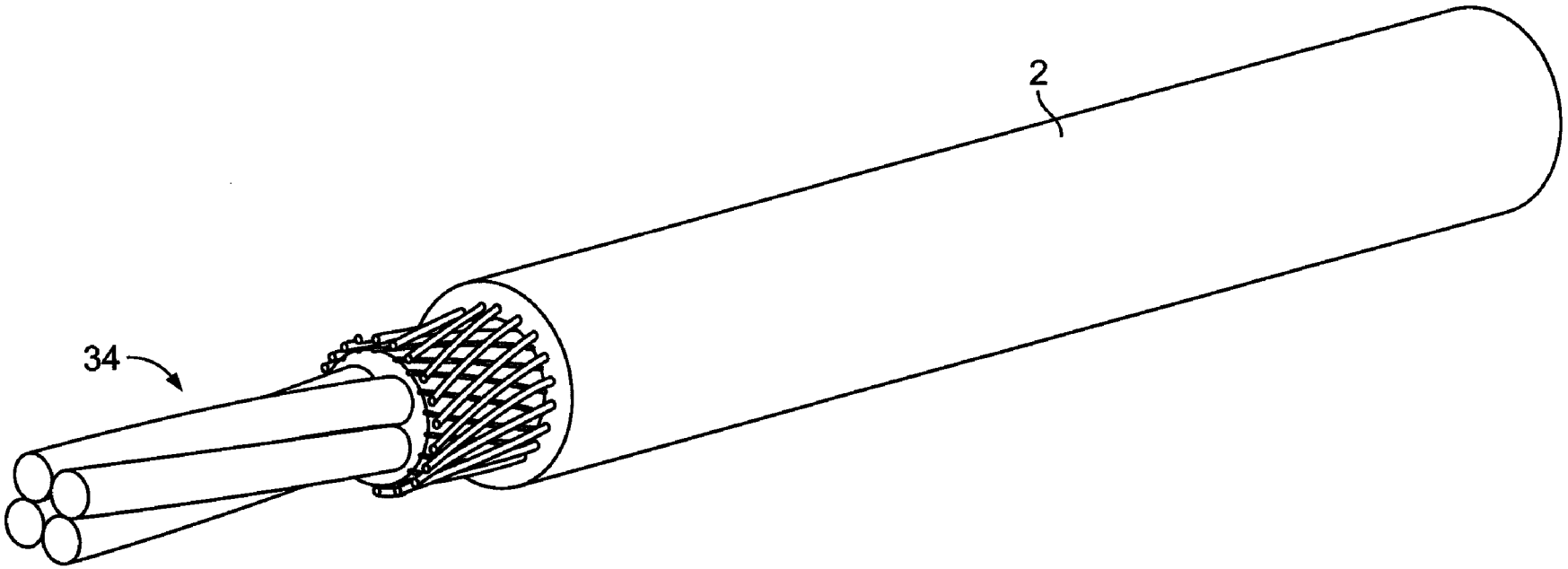

In addition to the improved reusability, the electric plug according to the invention is characterised in that, with relatively long vertical contacts 11 (ID contacts), the usable conductor cross-sectional area of the contacted electrical conductors can be increased. In this respect, FIGS. 8 and 9 show embodiments of two different cables 2, which contain electrical conductors 33 and 34 having different conductor cross sections. The cable 2 according to FIG. 9 can be, for example, a data cable, specifically designed for the network sector of the type generally known as "4 star". In this case, the electrical conductors 34 of the cable 2 can be connected in the first row 15 of the electric plug 1. Furthermore, the electric plug can be used in conjunction with a cable 2 according to FIG. 8 which is configured, for example, as an 8-pole industrial cable with eight electrical conductors 33 which have a smaller conductor cross section than the conductors 34 of the cable according to FIG. 9. The electrical conductors 33 of the cable, according to FIG. 8, are connected to the electric plug 1, such that four of the conductors 33 are connected to vertical contacts 11 (ID contacts) of the first row 15 and the other four electrical conductors 33 are connected to the vertical contacts 11 (ID contacts) of the second row 16. As a result of the increased installation space 5 in the first connection region 10 of the electric plug 1, it is possible to use vertical contacts 11 which are of a corresponding length so that the electrical conductors 33 of the cable (according to FIG. 8) and also the electrical conductors 34 which have a greater conductor cross section (according to the cable of FIG. 9) can be contacted.

The configuration of the embodiment, described hitherto, of an electric plug according to the invention which has been brought into contact with electrical conductors of an electric cable 2 will be described in detail with reference to FIGS. 4 to 7.

Figure 4:
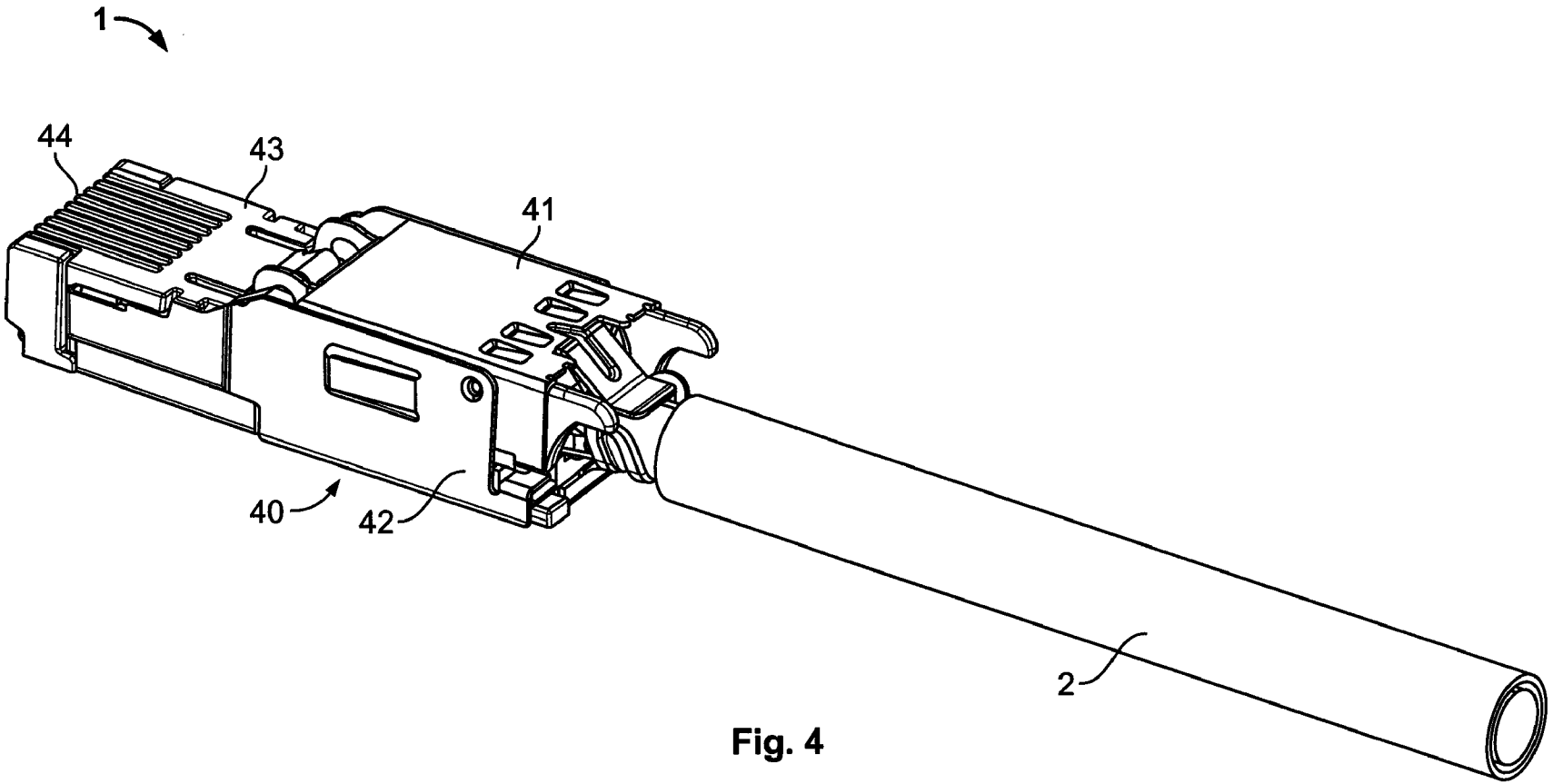
FIGS. 4 to 7 are in each case perspective views of the electric plug according to the exemplary embodiment according to FIGS. 1 to 3, different individual parts of the electric plug having been faded out in stages in the views of FIGS. 4 to 7.

In FIG. 4, the electric plug 1 according to the exemplary embodiment is shown in its complete form, the electrical conductors of the cable 2 having been brought into contact with the vertical contacts 11, which cannot be seen in FIG. 4. The housing 40 of the electric plug 1 includes a plurality of housing parts 41 to 44. An upper housing 41 is formed, for example by a shield sheet 41, which is connected on its lower side to a securing device (not shown in FIG. 4), which will be described in more detail in the following paragraphs. The housing 40 also includes lateral housing sections 42, as well as the already described front housing section 43 that is to form the plug-in face of the electric plug 1. Provided in the front housing section 43 are openings 44 which run parallel in the plug-in direction and form closely adjacent openings for connecting corresponding spring contacts of a counter connector, for example a socket or a coupling. The contact surfaces 22 of the horizontal contacts 21 are accessible at the openings 44, as described with reference to FIG. 3.

Figure 5:
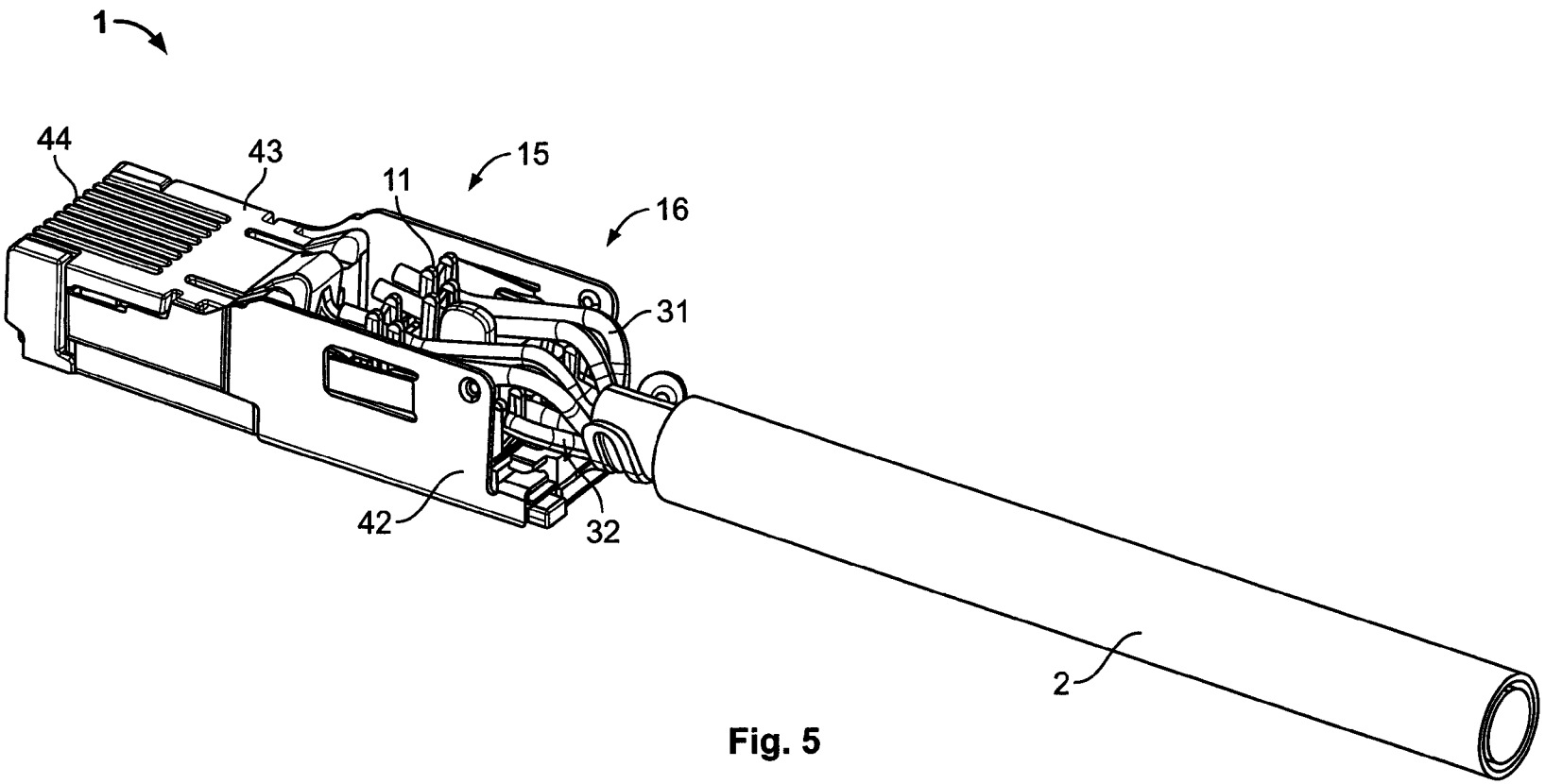

FIG. 5 shows a view according to FIG. 4, the upper housing 41 together with the securing device having been removed. In this embodiment, the cable 2 has eight electrical conductors 31, 32, individual conductors 31 of a first row being connected to vertical contacts 11 (ID contacts) of the first row 15 of the electric plug 1. The individual conductors 32 of the second row are connected to vertical contacts 11 of the second row 16.

Figure 6:
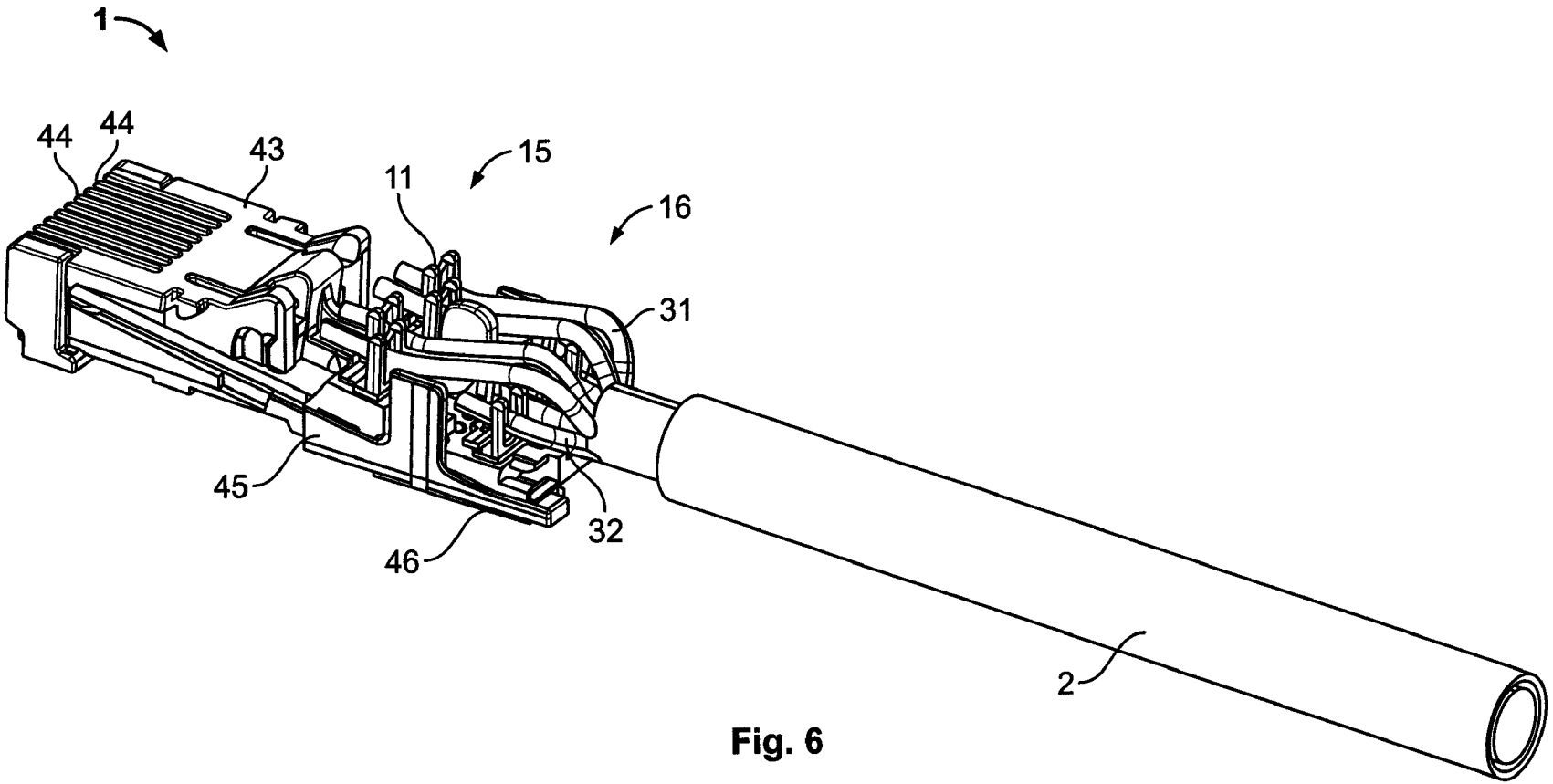

Compared to FIG. 5, FIG. 6 shows a view in which the lateral housing sections 42 have been removed. FIG. 6 clearly shows how the individual conductors 31 of the first row are guided away over the vertical contacts 11 of the second row 16 in order to be brought into contact with the vertical contacts 11 of the first row 15. FIG. 6 also shows a lower housing section 45 which forms on its lower side the datum plane 46 of the electric plug, wherein the datum plane 46 extends in the plug-in direction.

Figure 7:
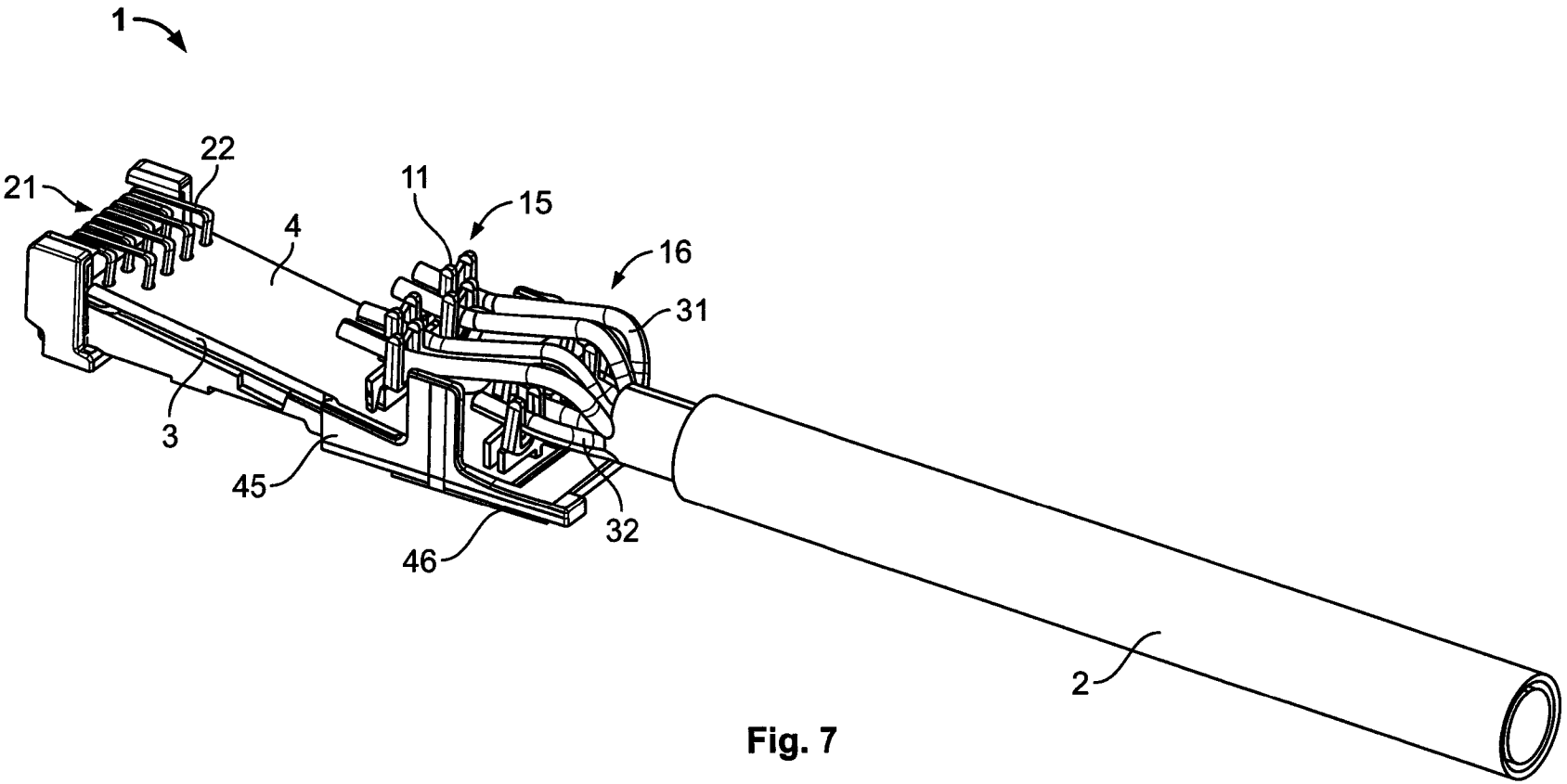

FIG. 7 also shows a view of the electric plug 1 with a connecting cable 2, the front housing section 43 having been removed. FIG. 7 clearly shows the inclined arrangement of the contact carrier 3 which is arranged in ascending manner with respect to the datum plane 46 starting from the cable connection region in which the vertical contacts 11 (ID contacts) are positioned. The ascending arrangement of the contact carrier 3 or of the upper surface 4 on which the vertical contacts 11 and the horizontal contacts 21 are positioned allows an increased installation space in the cable connection region, so that the individual conductors 31 of the first row can be guided over the vertical contacts 11 of the second row 16, without the length of the vertical contacts 11 having to be shortened for this purpose. Moreover, a relatively large installation space is available for the vertical contacts 11 of the first row 15, so that they can also be configured to be relatively long.

Figure 2:
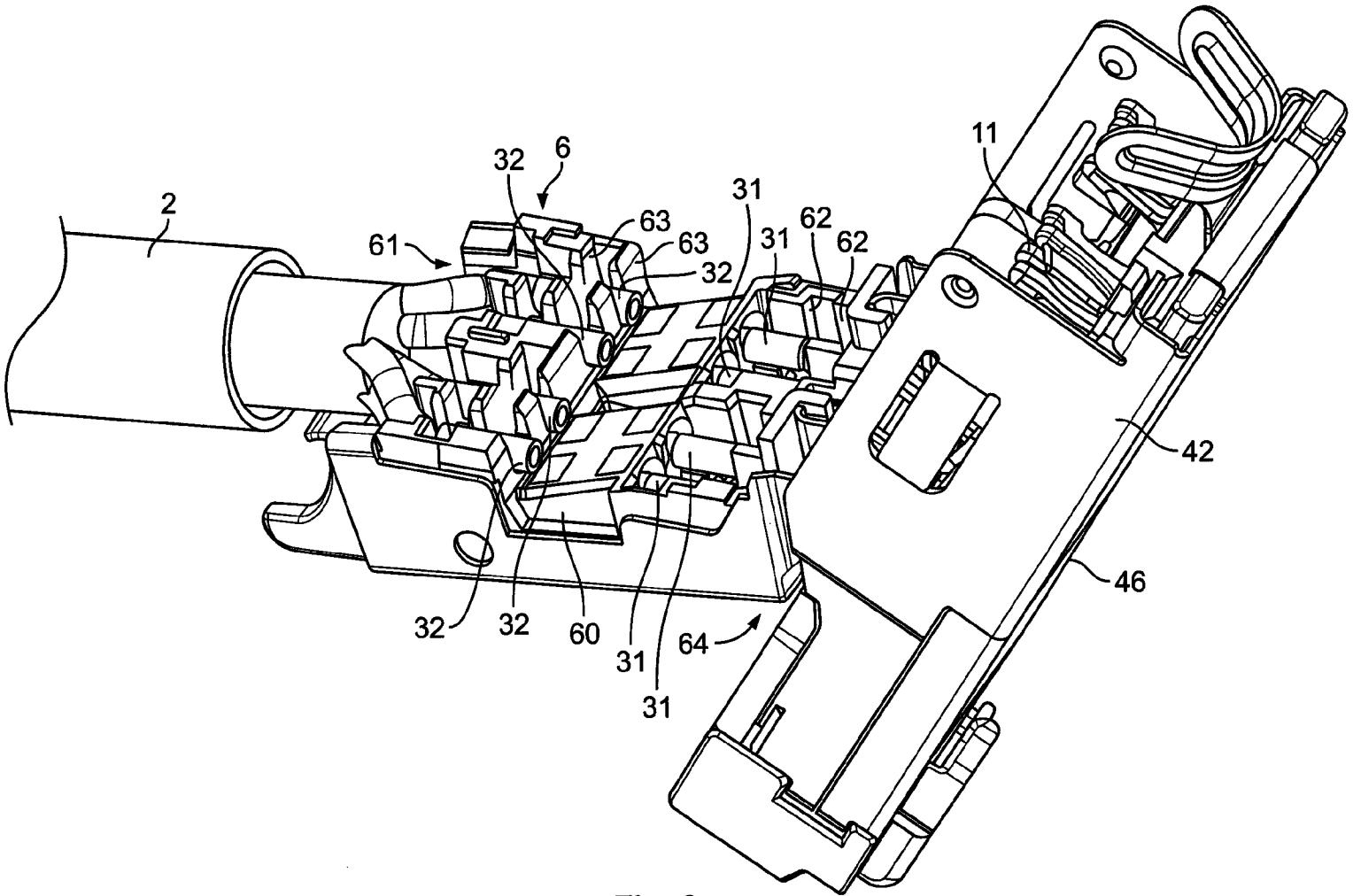
FIG. 2 is a perspective view of the electric plug according to FIG. 1 in a state before the electrical conductors are brought into contact with the vertical contacts.

The following description with reference to FIG. 2 in conjunction with FIGS. 4 to 7 will explain how the electrical conductors of the cable 2 according to an embodiment of the invention can be brought into contact with the electric plug 1.

As shown with reference to FIG. 2, a securing device 6 is provided for this purpose in which a plurality of electrical conductors, namely the individual conductors 31 of the first row and the individual conductors 32 of the second row, as described above, can be fixed. The securing device 6, also known as a "wire guide", comprises a uniform block 60 which bridges the electrical conductors 31, 32, guided parallel to one another, in a transverse direction to the plug-in direction and is provided with parallel recesses 61 for fixing the electrical conductors. For this purpose, provided in the recesses 61 are respective securing elements 62 and 63 into which the individual conductors 31, 32 are inserted and fixed. Thus, the securing device 6 serves to guide the individual conductors 31, 32 and is at the same time a type of plunger for pressing the wires into the vertical contacts 11.

Furthermore, the securing device 6 is secured by a hinge 64 to the lateral housing section 42 of the housing 40 of the electric plug. The securing device can be pivoted by the hinge 64, FIG. 2 showing a state in which the securing device 6 has been pivoted open to introduce the individual conductors 31, 32. A pivotal movement of the securing device 6 relative to the housing of the electric plug presses the individual conductors 31, 32 onto the vertical contacts 11 so that these vertical contacts 11 penetrate the wire insulation of the individual conductors and contact the underlying wires of the individual conductors. The electrical conductors are firmly anchored in the vertical contacts 11 by pressure of the plunger.

In the following, a method for connecting the individual conductors 31, 32 to the electric plug 1 according to the present embodiment will be described in detail. The electric plug is assembled as follows:

First of all, the individual electrical conductors 31 which are to be connected to the first row 15 of the vertical contacts 11 are inserted or introduced into a first row of securing elements 62, without, in so doing, projecting ends of the conductors being subsequently severed. In other words, the conductors 31 are introduced such that there are no projecting ends of the conductors, the cable being cut to the correct length before the individual conductors are introduced. The electrical conductors 32 are then introduced or inserted into a second row of securing elements 63 of the securing device 6, projecting ends of the conductors being subsequently severed before the individual conductors are brought into contact with the vertical contacts 11 (ID contacts). In this respect, the second row of securing elements 63 are located closer to the conductor-side end of the securing device 6 than the first row of securing elements 62. Fixing is carried out, for example by suitably clamping the individual conductors in the uniform block 60. After the individual conductors 31, 32 have been fixed in the securing device 6, said securing device 6 is pivoted in the direction of the vertical contacts 11 or the vertical contacts 11 are pivoted with the lower side of the housing in the direction of the securing device 6 in order to press the individual conductors onto the vertical contacts 11 for the electrical contacting of the wires by the vertical contacts 11 (ID contacts). In this respect, FIG. 4 shows the state in which the securing device 6 has been pivoted in with the rest of the electric plug housing, and the electrical conductors have been contacted by the vertical contacts 11.

The use according to the invention of an obliquely positioned contact carrier 3 (circuit board) in the electric plug 1 produces a compact construction of the electric plug 1, in which the electrical contacting of elongate electrical conductors, a cable 2 for example, is possible in a trailing end, it being possible to configure the leading end as a RJ45 plug. The contact carrier 3 (circuit board) is used at the same time for connecting the electrical conductors and for forming the front contact surfaces for contacting a counter connector.

The above description shows an exemplary embodiment of the invention, without being restricted thereto. For example, instead of a sheet-type contact carrier 3 (circuit board), any type of contact carrier 3 (circuit board) can generally be used which has an inclined upper surface or plane on which the described horizontal contacts 21 and vertical contacts 11 are provided.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

The invention claimed is:

1. Electric plug comprising:

a first connection region in which at least one vertical contact is provided for connecting at least one electrical conductor;

a second connection region in which at least one horizontal contact is provided for contacting a counter connector which is to be connected to the electric plug;

a contact carrier having an upper surface on which the vertical contact and the horizontal contact are provided, the contact carrier being configured to electrically interconnect the first and second connection regions;

wherein the contact carrier is arranged in a housing forming a datum plane on the lower side of the housing in the plug-in direction, the upper surface of the contact carrier being arranged in an inclined position with respect to the datum plane;

wherein the contact carrier is arranged in the housing such that the upper surface of the contact carrier is inclined in an ascending manner with respect to the datum plane in the plug-in direction, starting from the first connection region and ascending in the direction of the second connection region.

2. Electric plug according to claim 1, wherein the contact carrier comprises a printed circuit board which is arranged in an inclined position with respect to the datum plane and forms the upper surface of the contact carrier.

3. Electric plug according to claim 1, wherein in the first connection region a plurality of vertical contacts are arranged which are each provided for connecting a respective electrical conductor, at least two of the vertical contacts being arranged in tandem on the contact carrier in the plug-in direction.

4. Electric plug according to claim 2, wherein in the first connection region a plurality of vertical contacts are arranged which are each provided for connecting a respective electrical conductor, at least two of the vertical contacts being arranged in tandem on the contact carrier in the plug-in direction.

5. Electric plug according to claim 1, wherein in the first connection region a plurality of vertical contacts is arranged which are each provided for connecting a respective electrical conductor, the vertical contacts being positioned on the contact carrier in at least two rows which are arranged in tandem in the plug-in direction and extend transversely to the plug-in direction.

6. Electric plug according to claim 2, wherein in the first connection region a plurality of vertical contacts is arranged which are each provided for connecting a respective electrical conductor, the vertical contacts being positioned on the contact carrier in at least two rows which are arranged in tandem in the plug-in direction and extend transversely to the plug-in direction.

7. Electric plug according to claim 5, wherein when connected, some of the electrical conductors which are connected to vertical contacts of a first row are guided over vertical contacts of a second row.

8. Electric plug according to claim 1, wherein the vertical contacts are insulation displacement (ID) contacts for connecting a respective electrical conductor.

9. Electric plug according to claim 3, wherein the vertical contacts are insulation displacement (ID) contacts for connecting a respective electrical conductor.

10. Electric plug according to claim 5, wherein the vertical contacts are insulation displacement (ID) contacts for connecting a respective electrical conductor.

11. Electric plug according to claim 1, wherein the horizontal contact for contacting a counter connector has a straight contact surface that extends in the plug-in direction and is configured for contacting a spring contact of the counter connector.

12. Electric plug according to claim 1, wherein a securing device is provided in which a plurality of electrical conductors can be fixed and which is configured to jointly press the electrical conductors, which are fixed on the securing device, onto a corresponding number and arrangement of vertical contacts for an electrical contact.

13. Electric plug according to claim 3, wherein a securing device is provided in which a plurality of electrical conductors can be fixed and which is configured to jointly press the electrical conductors, which are fixed on the securing device, onto a corresponding number and arrangement of vertical contacts for an electrical contact.

14. Electric plug according to claim 5, wherein a securing device is provided in which a plurality of electrical conductors can be fixed and which is configured to jointly press the electrical conductors, which are fixed on the securing device, onto a corresponding number and arrangement of vertical contacts for an electrical contact.

15. Electric plug according to claim 11, wherein the securing device comprises a uniform block which bridges electrical conductors guided parallel to one another, in a transverse direction to the plug-in direction, and is provided with parallel recesses for fixing the electrical conductors.

16. Electric plug according to claim 13, wherein the securing device comprises a uniform block which bridges electrical conductors guided parallel to one another, in a transverse direction to the plug-in direction, and is provided with parallel recesses for fixing the electrical conductors.

17. Electric plug according to claim 14, wherein the securing device comprises a uniform block which bridges electrical conductors guided parallel to one another, in a transverse direction to the plug-in direction, and is provided with parallel recesses for fixing the electrical conductors.

18. Electric plug according to claim 1, wherein the electric plug is configured as a RJ45 connection system in the second connection region.

19. Electric plug according to claim 6, wherein when connected, some of the electrical conductors which are connected to vertical contacts of a first row are guided over vertical contacts of a second row.

20. Electric plug according to claim 2, wherein the vertical contacts are insulation displacement (ID) contacts for connecting a respective electrical conductor.

21. Electric plug according to claim 7, wherein the vertical contacts are insulation displacement (ID) contacts for connecting a respective electrical conductor.

22. Electric plug according to claim 2, wherein the horizontal contact for contacting a counter connector has a straight contact surface that extends in the plug-in direction and is configured for contacting a spring contact of the counter connector.

23. Electric plug according to claim 3, wherein the horizontal contact for contacting a counter connector has a straight contact surface that extends in the plug-in direction and is configured for contacting a spring contact of the counter connector.

24. Electric plug according to claim 5, wherein the horizontal contact for contacting a counter connector has a straight contact surface that extends in the plug-in direction and is configured for contacting a spring contact of the counter connector.

25. Electric plug according to claim 7, wherein the horizontal contact for contacting a counter connector has a straight contact surface that extends in the plug-in direction and is configured for contacting a spring contact of the counter connector.

26. Electric plug according to claim 2, wherein a securing device is provided in which a plurality of electrical conductors can be fixed and which is configured to jointly press the electrical conductors, which are fixed on the securing device, onto a corresponding number and arrangement of vertical contacts for an electrical contact.

27. Electric plug according to claim 7, wherein a securing device is provided in which a plurality of electrical conductors can be fixed and which is configured to jointly press the electrical conductors, which are fixed on the securing device, onto a corresponding number and arrangement of vertical contacts for an electrical contact.

28. Electric plug according to claim 8, wherein a securing device is provided in which a plurality of electrical conductors can be fixed and which is configured to jointly press the electrical conductors, which are fixed on the securing device, onto a corresponding number and arrangement of vertical contacts for an electrical contact.

29. Electric plug according to claim 12, wherein the securing device comprises a uniform block which bridges electrical conductors guided parallel to one another, in a transverse direction to the plug-in direction, and is provided with parallel recesses for fixing the electrical conductors.

30. Electrical plug according to claim 1, wherein the securing device is secured in a pivotal manner to the housing, the securing device being movable relative to the housing in a pivotal motion in order to secure the electrical conductors onto the at least one vertical contact.

* * * * *